US009898966B2

(12) United States Patent
Xu et al.

(10) Patent No.: US 9,898,966 B2
(45) Date of Patent: Feb. 20, 2018

(54) DISPLAY DEVICE AND METHOD FOR DRIVING DISPLAY DEVICE

(71) Applicant: Shenzhen China Star Optoelectronics Technology Co., Ltd., Shenzhen, Guangdong (CN)

(72) Inventors: Jing Xu, Guangdong (CN); Tai-jiun Hwang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 98 days.

(21) Appl. No.: 14/897,618

(22) PCT Filed: Nov. 2, 2015

(86) PCT No.: PCT/CN2015/093553
§ 371 (c)(1),
(2) Date: Dec. 10, 2015

(87) PCT Pub. No.: WO2017/067020
PCT Pub. Date: Apr. 27, 2017

(65) Prior Publication Data

US 2017/0193903 A1 Jul. 6, 2017

(51) Int. Cl.
*G09G 3/32* (2016.01)
*G09G 3/3258* (2016.01)

(52) U.S. Cl.
CPC ..... *G09G 3/3258* (2013.01); *G09G 2310/08* (2013.01); *G09G 2320/0626* (2013.01)

(58) Field of Classification Search
CPC ..... G09G 3/3258; G09G 2310/08; G09G 2320/0626
See application file for complete search history.

(56) References Cited

U.S. PATENT DOCUMENTS

2016/0012774 A1* 1/2016 Ohara ..... G09G 3/2025 345/694

* cited by examiner

*Primary Examiner* — Liliana Cerullo
(74) *Attorney, Agent, or Firm* — Andrew C. Cheng

(57) ABSTRACT

A method for driving a display device includes: dividing static frames displayed by the display device into a first frame and a second frame, which comprises a first sub-frame and a second sub-frame; outputting grey-scale images during the display period of the first frame and the first sub-frame; outputting dark state images during the display period of the second sub-frame, where the length of the display period of the second sub-frame is proportional to that of the static frames. The present invention also proposes a display device using the method. The brightness of the display device can be dynamically adjusted, preventing the device from operating in high brightness for a long period of time, and prolonging its lifespan.

11 Claims, 3 Drawing Sheets

DISPLAY DEVICE AND METHOD FOR DRIVING DISPLAY DEVICE

BACKGROUND OF THE INVENTION

1. Field of the Invention

The present invention relates to display technology field, more particularly to a display device and a method for driving the display device.

2. Description of the Prior Art

Compared to a liquid crystal display device, an organic light-emitting diode (OLED) display device consumes less energy, for it is self-lighting and needs no backlight modules. The brightness of an OLED display device is determined by driving current. The greater the driving current is, the brighter the display becomes. This means a significantly greater amount of driving current will be received when an OLED device displays high brightness images in a given amount of time, a fact leading to accelerated aging of the device, which enormously deteriorates display quality.

To prolong lifespan of an OLED display device, "black frame insertion" is a commonly deployed method in conventional technology for lowering brightness; that is, insertion of a black frame after an image frame. In current practice, the insertion rate is usually a simple constant based on frame time or frame numbers, not taking into account of mean-time brightness, and thus deteriorates image quality for viewers.

SUMMARY OF THE INVENTION

Accordingly, the present invention provides a display device and a method for driving the display device, which adjusts brightness according to display time of static frames in order to prolong lifespan of the display device.

According to the present invention, a method for driving a display device comprises: dividing static frames displayed by the display device into a first frame and a second frame, which comprises a first sub-frame and a second sub-frame, a length of the display period of the first frame being equivalent to that of the second frame; outputting grey-scale images during the display period of the first frame and the first sub-frame, wherein during the display period of the first frame, a plurality of gate lines of the display device are turned on one by one, and a plurality of data lines of the display device outputs grey-scale voltage so to display the grey-scale images, during the display period of the first sub-frame, all gate lines are turned off and all data lines stop outputting the grey-scale voltage; and during the display period of the second sub-frame, the plurality of gate lines are turned on at the same time and the data lines output dark state voltage to show dark state images, where the length of the display period of the second sub-frame is proportional to that of the static frames.

Furthermore, the method further comprises: outputting the grey-scale images during the display period of dynamic frames of the display device.

Furthermore, the dark state images comprise black images and grey images.

According to the present invention, a method for driving a display device comprises: dividing static frames displayed by the display device into a first frame and a second frame, which comprises a first sub-frame and a second sub-frame; outputting grey-scale images during the display period of the first frame and the first sub-frame; and outputting dark state images during the display period of the second sub-frame, where the length of the display period of the second sub-frame is proportional to that of the static frames.

Furthermore, during the display period of the first frame, a plurality of gate lines of the display device are turned on one by one, and a plurality of data lines of the display device outputs grey-scale voltage so to display the grey-scale images. During the display period of the first sub-frame, all gate lines are turned off and all data lines stop outputting the grey-scale voltage. During the display period of the second sub-frame, the plurality of gate lines are turned on at the same time and the data lines output dark state voltage to show dark state images.

Furthermore, the length of the display period of the first frame is equivalent to that of the second frame.

Furthermore, the method further comprises outputting the grey-scale images during the display period of dynamic frames of the display device.

Furthermore, the dark state images comprise black images and grey images.

According to the present invention, a display device comprises a timing controller and a data driver for driving data lines. The timing controller comprises: a detecting module, for detecting whether the display device enters into the display period of the static frames; a clock module, for dividing the display period of static frames into two display periods, one for the first frame and the other for the second frame, which comprises a first sub-frame and a second sub-frame; a timing module, for timing the length of the display period of static frames; a control module, for controlling the data driver to output grey-scale images during the display periods of the first frame and the first sub-frame, and output dark state images during the display period of the second sub-frame, wherein the length of the display period of the second sub-frame is proportional to that of the static frames.

Furthermore, the display device further comprises a plurality of gate lines and a gate driver for driving the gate lines. During the display period of the first frame, the control module controls the gate driver to turn on the plurality of gate lines one by one, and controls the data driver to output grey-scale voltage to the data lines so to show the grey-scale images. During the display period of the first sub-frame, the control module controls the gate driver to turn off all the gate lines, and controls the data driver to stop outputting the grey-scale voltage to all the data lines. During the display period of the second sub-frame, the control module controls the gate driver to turn on the plurality of gate lines at the same time, and controls the data driver to output dark state voltage to the data lines to show the dark state images.

Furthermore, the detecting module is further used to detect whether the display device enters into the display period of dynamic frames. If yes, then during the display period of dynamic frames, the control module controls the gate driver to turn on the plurality of gate lines one by one, and controls the data driver to output the grey-scale voltage to the data lines to show the grey-scale images.

Furthermore, the length of the display period of the first frame is equivalent to that of the second frame.

Furthermore, the dark state images comprise black images and grey images.

The display device and method for driving the display device of the present invention divides static frames into the first frame and the second frame. The second frame comprises the first sub-frame that shows grey-scale images and the second sub-frame that shows dark state images. The present invention adjusts the length of the display period of the second sub-frame proportional to that of the static frames. Therefore, the longer the static images display, the longer the dark state image displays; the shorter the static images display, the shorter the dark state image displays. By doing so, the brightness of the display device can be dynamically adjusted, preventing the device from operating in high brightness for a long period of time. The present invention thus slows down the device's aging and prolongs its lifespan, ensuring display quality.

DETAILED DESCRIPTION OF PREFERRED EMBODIMENTS

The drawings illustrate embodiments of the invention and, together with the description, serve to explain the principles of the invention.

Figure 1:
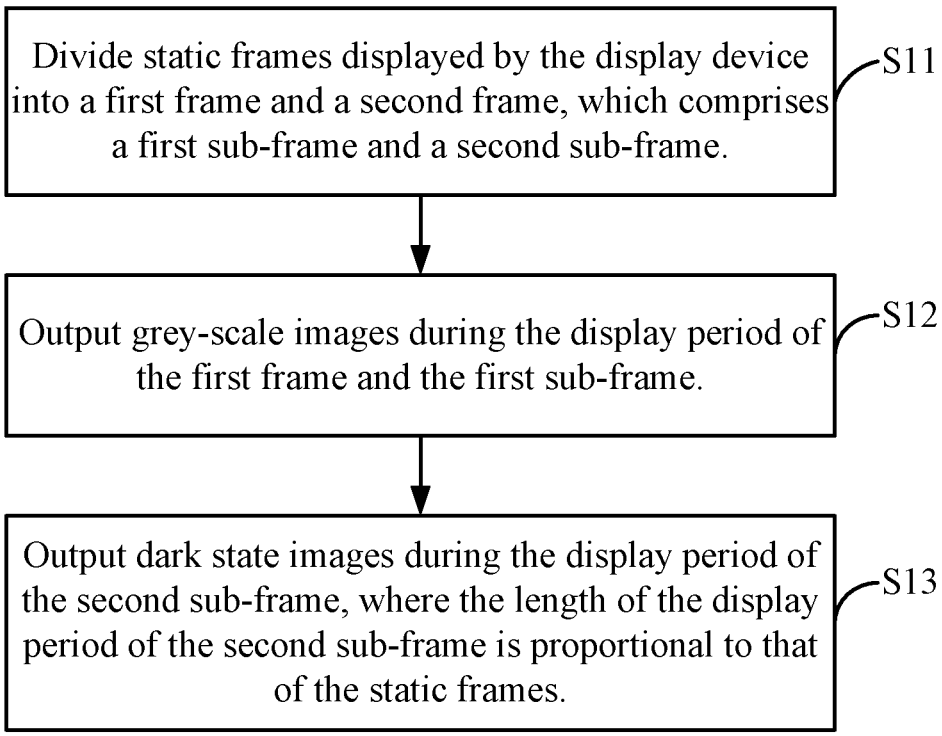
FIG. 1 illustrates a flowchart of a method of driving a display device according to a preferred embodiment of the present invention.
Figure 2:
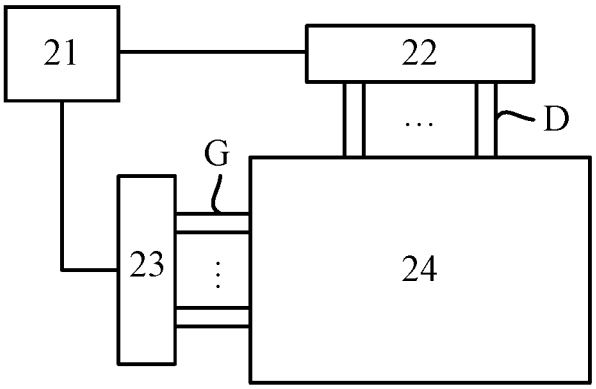
FIG. 2 shows a schematic diagram of a display device according to a preferred embodiment of the present invention.

The embodiment of the present invention provides a method for driving display device, as shown in FIG. 1, to drive a display device, as shown in FIG. 2. The display device can be an OLED display device and comprises a timing controller 21, a data driver 22, a gate driver 23 and a display panel 24. The timing controller 21 produces control signals to control the digital driver 22 and the gate driver 23 so to drive the display panel 24 to show images.

The display panel 24 comprises a plurality of gate lines G, arranged in horizontal rows with a space in between, and a plurality of data lines D, arranged in vertical lines with a space in between and perpendicularly intersecting with but insulated from the gate lines. A plurality of pixel units of the display device arranged in arrays is defined by the plurality of intersecting gate lines G and data lines D. Each pixel unit connects to a corresponding thin film transistor (TFT). A drain of the TFT connects the pixel unit, the gate connects the gate line and a source connects the data line. The gate driver 23 connects scan lines G and provides scan signals to pixel units through scan lines G. The data driver 22 connects data lines D and provides data signals (grey-scale signals) to pixel units through data lines D. The scan signals scan through each line, and control switch signals of pixel units of each line. The switch signals, jointly affecting the TFT with data signals, controls the TFT by turning it on and off, and therefore controls the current that runs through the pixel units that are connected to the TFT. When the TFT is turned on, the data signals can charge the storage capacitor through the TFT, and thus the display device can illuminate during the display period of each frame to show images.

Please refer to FIG. 1. The method for driving of the present embodiment comprises the following steps.

Step S11: divide the static frames displayed by the display device as a first frame and a second frame. The second frame comprises a first sub-frame and a second sub-frame.

Step S12: output a grey-scale image during the display period of the first frame and the first sub-frame.

Step S13: output a dark state image during the display period of the second sub-frame. The length of the display period of the second sub-frame is proportional to that of the static frames.

First, determine whether the current image to be displayed is a static frame or dynamic frame. For example, assume that there is a mountain and a cloud in a previous frame and the current frame, which are consecutive. If the position of the cloud in the previous frame is the same as that in the current frame, the current frame is static. Methods for determining whether the current frame is static or dynamic is not limited to the one mentioned here. The present embodiment of the invention does not impose any limit on the determining method.

Figure 3:
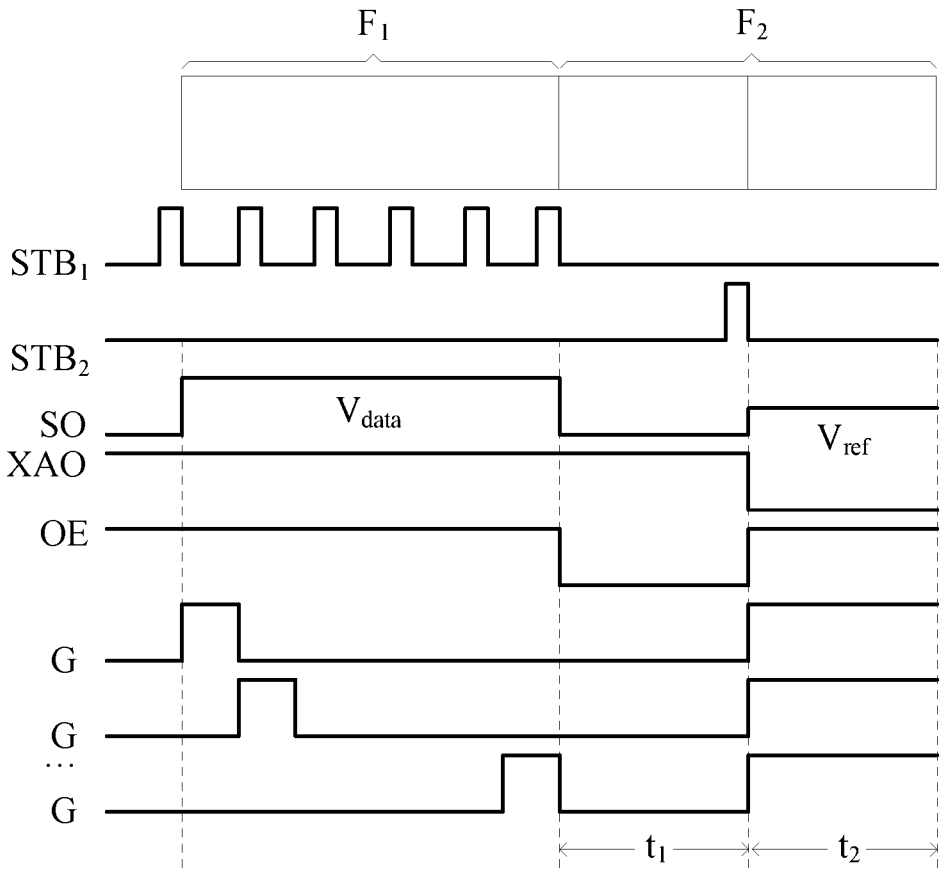
FIG. 3 shows a timing diagram of related signals applied on the display device.

When an image data is received, the display device analyzes the data and divides the display period of each static frame into an image period and a dark state period, as shown in FIG. 3. The image period comprises the display period of the first frame $F_1$ and the display period $t_1$ of the first sub-frame of the second frame $F_2$. The dark state period is the display period $t_2$ of the second sub-frame. During the image period, the data driver 22 writes a grey-scale voltage corresponding to the grey-scale image for the display panel 24 under the control of the timing controller 21. During the dark state period, the data driver 22 writes a dark state voltage corresponding to the dark state image for the display panel 24 under the control of the timing controller 21. In addition, during the display period of dynamic frames of the display device, the data driver 22 writes a grey-scale voltage corresponding to the grey-scale image for the display panel 24 under the control of the timing controller 21. Note that the grey-scale image during the image period and the dark state image during the dark state period are two kinds of images displayed by the display panel 24.

The length of the display period of the first frame is the same as that of the second frame. It means that an image with frequency at 60 Hz will become an image with frequency at 120 Hz if frequency multiplication is applied to each static frame.

In practice, the embodiment of the present invention is a method for driving through insertion of black or grey frames, referred to as dark state images in the previous texts. The timing of black or grey frame insertion can be adjusted by the length of the display period of the static frames.

As shown in FIG. 3, the embodiment of the present invention controls signal output of the gate lines through output enable (OE) signal, a gate driving signal; controls signal output of the data lines through strobe input (STB), a grey-scale driving signal; and controls and turns on all the gate lines G through XAO signal, a voltage detection result signal. More specifically:

During the display period of the first frame $F_1$, the gate driving signal OE outputs high level. The gate driver 23 controls and turns on each gate line G one by one to output high level, and turns on TFT corresponding to each gate line G. The first grey-scale driving signal $STB_1$ turns from high to low, while the data driver 22 outputs grey-scale signal SO to data lines D. The grey-scale signal SO corresponds to grey-scale voltage $V_{data}$, and charges pixel units to show grey-scale images.

During the display period $t_1$ of the first sub-frame of the second frame $F_2$, the gate driving signal OE outputs low level, and the gate driver 23 controls and turns off all the gate lines G. Concurrently, the first grey-scale driving signal $STB_1$ outputs low level, and data driver 22 outputs a low level grey-scale signal SO, such as zero, to the data line D. That is, all the data lines D stop outputting grey-scale voltage. At this moment, the storage capacitor of pixel units provides power so that the display device can still show grey-scale images.

During the display period $t_2$ of the second sub-frame of the second frame $F_2$, the gate driving signal OE outputs high level, and the gate driver 23 controls and turns on each gate line G at the same time to output high level. Concurrently, the second grey-scale driving signal $STB_2$ comes to its falling edge. The data driver 22 outputs grey-scale signal SO to the data line D. The grey-scale signal SO corresponds to a grey-scale voltage $V_{ref}$, which is smaller than a grey-scale voltage $V_{data}$. The pixel units are thus charged to show dark state images. If dark state images are black images, the grey-scale voltage $V_{ref}$ would appear as the grey-scale driving voltage when the display device shows black images; if dark state images are grey images, the grey-scale voltage $V_{ref}$ would appear as the grey-scale driving voltage when the display device shows grey images.

In the embodiment of the present invention, the length of the display period $t_2$ of the second sub-frame is proportional to that of the static frames. In other words, the embodiment of the present invention adjusts the length of the display period $t_2$ of the second sub-frame proportional to that of the static frames. Therefore, the longer the static images display, the longer the dark state image displays; the shorter the static images display, the shorter the dark state image displays. By doing so, the brightness of the display device can be dynamically adjusted, lowering the brightness of the display device when it is operating in static image mode for a long period of time, and thus slowing down the device's aging and prolonging its lifespan, ensuring display quality.

Figure 4:
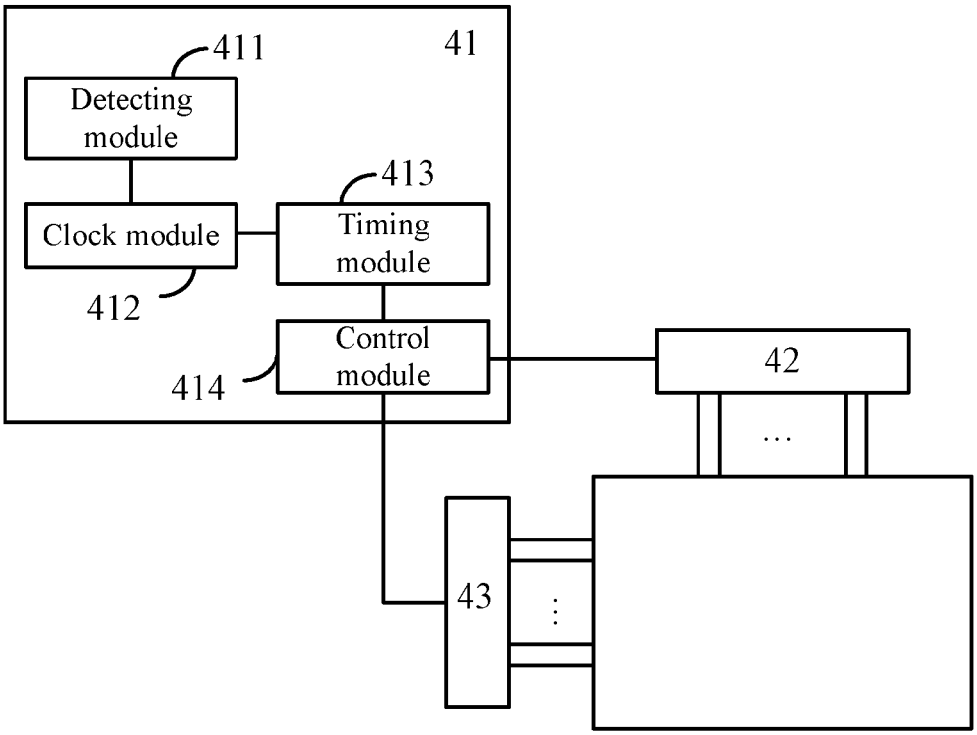
FIG. 4 shows a schematic diagram of a display device according to another preferred embodiment of the present invention.

The embodiment of the present invention further provides a display device as shown in FIG. 4. A display device 40 comprises a timing controller 41, data driver 42 and gate driver 43. The timing controller 41 is for producing control signals to control the data driver 42 and gate driver 43 so that the display device 40 shows images. The timing controller 41 comprises a detecting module 411, a clock module 412, a timing module 413 and a control module 414.

The detecting module 411 is for detecting whether the display device 40 enters into the display period of static frames. Therefore, it is also used to detect whether the display device 40 enters into the display period of dynamic frames.

The clock module 412 is for dividing the display period of static frames into two display periods, one for the first frame and the other for the second frame. The second frame comprises the first sub-frame and second sub-frame. The length of the display period of the first frame can be equivalent to that of the second frame.

The timing module 413 is for timing the length of the display period of static frames.

The control module 414 is for controlling the data driver 42 so that the display device 40 outputs grey-scale images during the display periods of the first frame and the first sub-frame, and outputs dark state images during the display period of the second sub-frame. The dark state images comprise black images and grey images.

The length of the display period of the second sub-frame is proportional to that of the static frames. More specifically, during the display period of the first frame, the control module 414 controls the gate driver 43 to turn on a plurality of gate lines one by one, and controls the data driver 42 to output grey-scale voltage to data lines to show grey-scale images. During the display period of the first sub-frame, the control module 414 controls the gate driver 43 to turn off all gate lines, and controls the data driver 42 to stop outputting grey-scale voltage to data lines. During the display period of the second sub-frame, the control module 414 controls the gate driver 43 to turn on the plurality of gate lines at the same time, and controls the data driver 42 to output dark state voltage to data lines to show dark state images.

In addition, when the detecting module 411 detects that the display device 40 enters into the display period of dynamic frames, it controls the gate driver 43 to turn on the plurality of gate lines one by one, and controls the data driver 42 to output grey-scale voltage to data lines to show grey-scale images.

The multi-module structure of the timing controller 41 of the display device 40 delivers the same technical effect when implementing the method of the embodiment mentioned above.

The implementation of the timing controller 41 is merely schematic. The modules are divided merely based on their logical functions, and can be divided differently when putting into practice. For example, two modules can be integrated into another system, or some features can be ignored, or skipped during implementation. In addition, modules can be connected through interfaces, or electrically, or by other means. The modules, as components of timing controller 41, are not limited to physical blocks. They can locate in one place or be deployed to a plurality of network units. They can appear in the form of software functional blocks or as hardware.

The display device and method for driving the display device of the present invention divides static frames into the first frame and the second frame. The second frame comprises the first sub-frame that shows grey-scale images and the second sub-frame that shows dark state images. The present invention adjusts the length of the display period of the second sub-frame proportional to that of the static frames. Therefore, the longer the static images display, the longer the dark state image displays; the shorter the static images display, the shorter the dark state image displays. By doing so, the brightness of the display device can be dynamically adjusted, preventing the device from operating in high brightness for a long period of time. The present invention thus slows down the device's aging and prolongs its lifespan, ensuring display quality.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A method for driving a display device, comprising:

dividing a static frame displayed by the display device into a first frame and a second frame, the second frame comprising a first sub-frame and a second sub-frame, a length of the display period of the first frame being equivalent to a length of the display period of the second frame;

outputting grey-scale images during the display period of the first frame and the first sub-frame, wherein during the display period of the first frame, a plurality of gate lines of the display device are turned on one by one, and a plurality of data lines of the display device outputs grey-scale voltage so to display the grey-scale images, during the display period of the first sub-frame, all gate lines are turned off and all data lines stop outputting the grey-scale voltage; and during the display period of the second sub-frame, the plurality of gate lines are turned on at the same time and the data lines output dark state voltage to show dark state images, where the length of the display period of the second sub-frame is proportional to the length of the display period of the static frame.

2. The method of claim 1, further comprising:

outputting the grey-scale images during the display period of dynamic frames of the display device.

3. The method of claim 1, wherein the dark state images comprise black images.

4. A method for driving a display device, comprising:

dividing a static frame displayed by the display device into a first frame and a second frame, the second frame comprising a first sub-frame and a second sub-frame;

outputting grey-scale images during the display period of the first frame and the first sub-frame; and outputting dark state images during the display period of the second sub-frame, where the length of the display period of the second sub-frame is proportional to the length of the display period of the static frame, wherein the length of the display period of the first frame is equivalent to the length of the display period of the second frame.

5. The method of claim 4, wherein during the display period of the first frame, a plurality of gate lines of the display device are turned on one by one, and a plurality of data lines of the display device outputs grey-scale voltage so to display the grey-scale images;

during the display period of the first sub-frame, all gate lines are turned off and all data lines stop outputting the grey-scale voltage;

during the display period of the second sub-frame, the plurality of gate lines are turned on at the same time and the data lines output dark state voltage to show dark state images.

6. The method of claim 4, further comprising:

outputting the grey-scale images during the display period of dynamic frames of the display device.

7. The method of claim 4, wherein the dark state images comprise black images.

8. A display device, comprising a timing controller and a data driver for driving data lines, with the timing controller comprising:

a detecting module, for detecting whether the display device enters into a display period of a static frame;

a clock module, for dividing the display period of the static frame into two display periods, one for a first frame and the other for a second frame, the second frame comprising a first sub-frame and a second sub-frame;

a timing module, for timing the length of the display period of a static frame;

a control module, for controlling the data driver to output grey-scale images during the display periods of the first frame and the first sub-frame, and output dark state images during the display period of the second sub-frame, wherein the length of the display period of the second sub-frame is proportional to the length of the display period of the static frame, wherein the length of the display period of the first frame is equivalent to a length of the display period of the second frame.

9. The display device of claim 8, wherein the display device further comprises a plurality of gate lines and a gate driver for driving the gate lines;

during the display period of the first frame, the control module controls the gate driver to turn on the plurality of gate lines one by one, and controls the data driver to output grey-scale voltage to the data lines so to show the grey-scale images;

during the display period of the first sub-frame, the control module controls the gate driver to turn off all the gate lines, and controls the data driver to stop outputting the grey-scale voltage to all the data lines;

during the display period of the second sub-frame, the control module controls the gate driver to turn on the plurality of gate lines at the same time, and controls the data driver to output dark state voltage to the data lines to show the dark state images.

10. The display device of claim 9, wherein the detecting module is further used to detect whether the display device enters into the display period of dynamic frames; upon a condition that the display device enters into the display period of dynamic frames, during the display period of dynamic frames, the control module controls the gate driver to turn on the plurality of gate lines one by one, and controls the data driver to output the grey-scale voltage to the data lines to show the grey-scale images.

11. The display device of claim 8, wherein the dark state images comprise black images.

* * * * *